US007421963B1

(12) United States Patent
Victor

(10) Patent No.: US 7,421,963 B1
(45) Date of Patent: Sep. 9, 2008

(54) WATERCRAFT DRY STORAGE AND STORAGE METHOD

(76) Inventor: Remi L. Victor, 845 Collier Ct., Unit 206, Marco, FL (US) 34145

( * ) Notice: Subject to any disclaimer, the term of this patent is extended or adjusted under 35 U.S.C. 154(b) by 0 days.

(21) Appl. No.: 11/509,883

(22) Filed: Aug. 25, 2006

Related U.S. Application Data

(63) Continuation-in-part of application No. 10/913,115, filed on Aug. 6, 2004, now Pat. No. 7,096,809.

(60) Provisional application No. 60/492,891, filed on Aug. 6, 2003.

(51) Int. Cl.
*B63B 1/02* (2006.01)

(52) U.S. Cl. ..... 114/45; 114/49

(58) Field of Classification Search ..... 441/40, 441/44, 45; 114/263, 44, 45, 49, 54, 345, 114/61.25; 403/3
See application file for complete search history.

(56) References Cited

U.S. PATENT DOCUMENTS 1,447,064 A * 2/1923 Cousins ..... 59/35.1
5,713,817 A * 2/1998 Buchanan ..... 482/23
5,860,379 A * 1/1999 Moody ..... 114/54
6,343,560 B1 * 2/2002 Myers ..... 114/61.25
7,096,809 B1 * 8/2006 Victor ..... 114/45
2004/0139904 A1 * 7/2004 Mears ..... 114/219
2005/0268837 A1 * 12/2005 Mears ..... 114/263

* cited by examiner

*Primary Examiner*—Sherman Basinger
(74) *Attorney, Agent, or Firm*—Robert L. Farris; Farris Law, P.C.

(57) ABSTRACT

The watercraft dry storage assembly includes two generally cylindrical bladders that are inflated to lift a boat from the water and hold the hull in a raised position. Each bladder is made from a scrim encased in a flexible plastic. The scrim is substantially non-stretchable. Air fills the bladders until each inch of bladder material is tensioned in a direction parallel to a long axis of the bladder by a force of at least 5 pounds and in a transverse direction by a force of at least 10 pounds. A plurality of straps encircle each bladder. Rings on the ends of each strap are connected by coupler assemblies to secure both bladders together. The straps are attached to the bladders in selected positions along the length of the bladders.

8 Claims, 11 Drawing Sheets

WATERCRAFT DRY STORAGE AND STORAGE METHOD

CROSS REFERENCE TO RELATED APPLICATIONS

This application is a continuation in part of application Ser. No. 10/913,115 filed Aug. 6, 2004 and now U.S. Pat. No. 7,096,809 which claims benefit of application Ser. No. 60/492,891 filed Aug. 6, 2003.

FIELD OF THE INVENTION

A boat is protected from contaminants in water and water borne organisms during extended periods of non-use by inflatable bladders that lift the hull above the surface of the water, an envelope with an open top edge that encases the keel, rudder and/or propeller as required, an envelope holder that secures the open edge of the envelope above the surface of the water, and a pump that removes water from the envelope.

BACKGROUND OF THE INVENTION

Boats are usually taken out of the water during extended periods of non-use. Removal from the water is expensive for boats that are to large to be carried on a trailer pulled by a small truck or car. Removal as well as return to the water may have to be scheduled weeks or even months in advance. As a result a boat is often unavailable for use on days when the weather is excellent for boating.

Boats are often left in the water during periods of non-use of a few weeks. Contaminants in the water can stick to and stain surfaces of the boat hull and keel. Various water borne organisms can attach to the hull, grow for periods of time and damage the hull and keel surfaces.

Inflatable airbags have been used to lift the hull of boats above the surface of the water. These airbags have not however lifted the keel of a sailboat out of the water. The rudder and prop of motorboats may also remain in the water. Sailboats with a fixed keel would be unstable if the hull and the keel were both lifted above the water by airbags.

Flexible containers have been employed to receive the submerged surfaces of ocean going ships. These containers receive chemical that kill marine life attached to the ship hull. Pumps are provided to pump water and chemicals into and out of the container. Following the chemical treatment, the ship is returned to service. The system is for quick treatment to remove marine life from a ship hull. Damage to the hull has most likely occurred prior to chemical treatment. The pumps and chemical storage tanks are on a barge that has substantial size. Two small boats are used to pull one of the containers from the barge. Multiple motors are required to power pumps, wenches, screws and other portions of the system. Such systems are clearly designed to periodically treat the hulls of a number of ships each year.

SUMMARY OF THE INVENTION

The watercraft storage assembly includes a port bladder and a starboard bladder made from sheet material with a substantially non-stretchable scrim encased in a flexible plastic and formed into generally cylindrical air impervious containers. A plurality of port strap assemblies are spaced apart along a port bladder long axis. Each port strap assembly includes an elongated strap that substantially encircles the port bladder. An upper port ring is attached to an upper end of the elongated strap. A lower port ring is attached to a lower end of the elongated strap. A plurality of starboard strap assemblies are spaced apart along the starboard bladder long axis. Each strap assembly includes an elongated strap that substantially encircles the starboard bladder. An upper starboard ring is attached to an upper end of the elongated strap. A lower starboard ring is attached to a lower end of the elongated strap. A plurality of coupler assemblies are included. Each coupler assembly connects the upper port ring and the lower port ring of one port strap assembly and the upper starboard ring and the lower starboard ring of one starboard strap assembly together. A blower system includes a blower connected to a manifold. A port bladder tube is connected to the port bladder and to the manifold. A starboard bladder tube is connected to the starboard bladder and to the manifold. A first valve controls the flow of air between the manifold and the part bladder. A second valve controls the flow of air between the manifold and the starboard bladder.

A plurality of coupler assemblies include a coupler closure for opening and closing chain couplers. The coupler assemblies may include a plurality of chain couplers to increase the space between bladders.

Each port strap assembly includes a panel sewn to the elongated strap and fixed to the port bladder. Each starboard strap assembly also includes a panel sewn to the elongated strap and fixed to the starboard bladder.

BRIEF DESCRIPTION OF THE DRAWINGS

The presently preferred embodiments of the invention are disclosed in the following description and in the accompanying drawing, wherein.

DETAILED DESCRIPTION OF THE PREFERRED EMBODIMENTS

Figure 7:
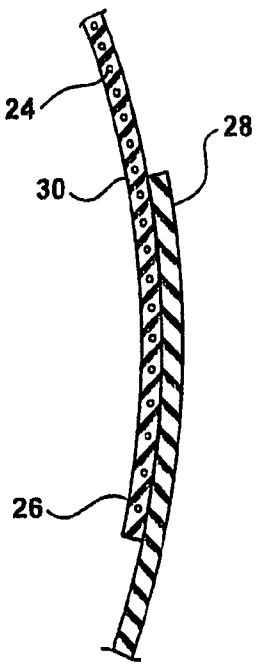
FIG. 7 is an enlarged sectional view taken along line 7-7 in FIG. 6.
Figure 6:
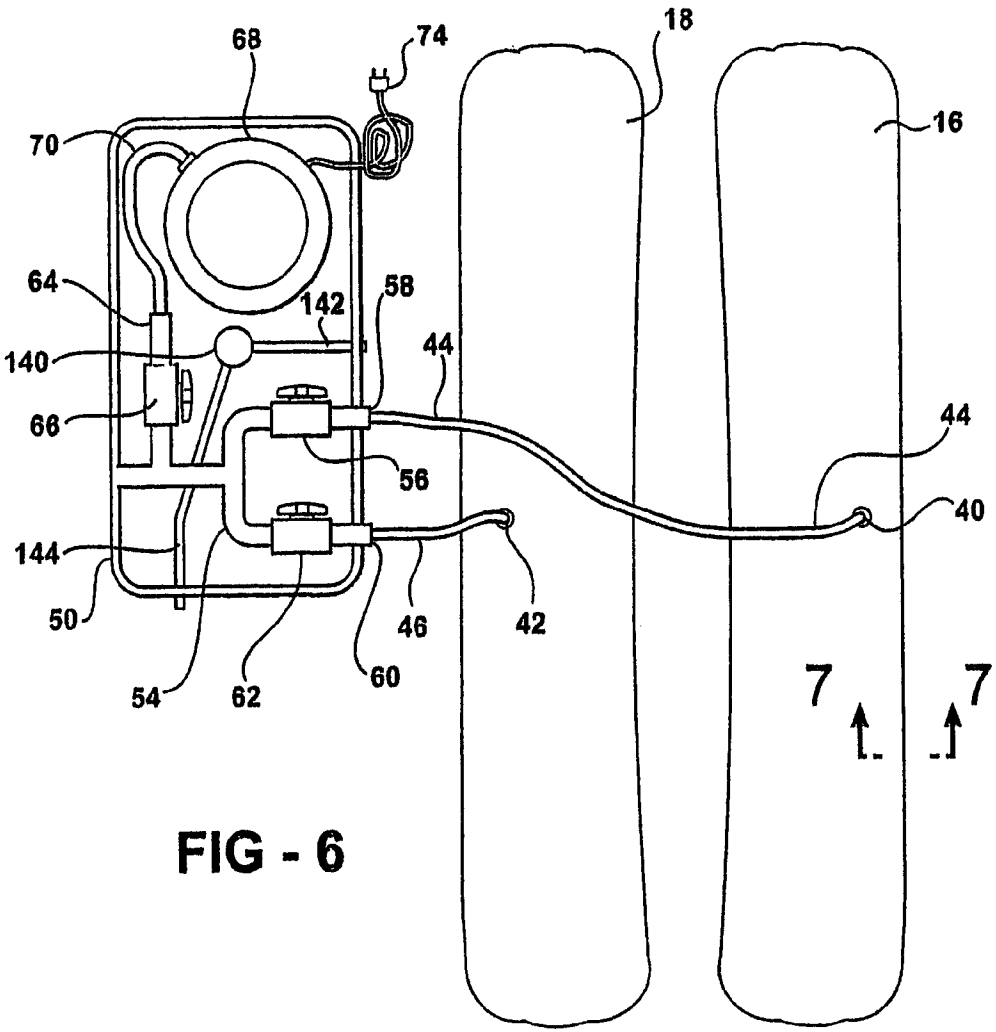
FIG. 6 is a schematic view of two bladders and the bladder inflation system.
Figure 8:
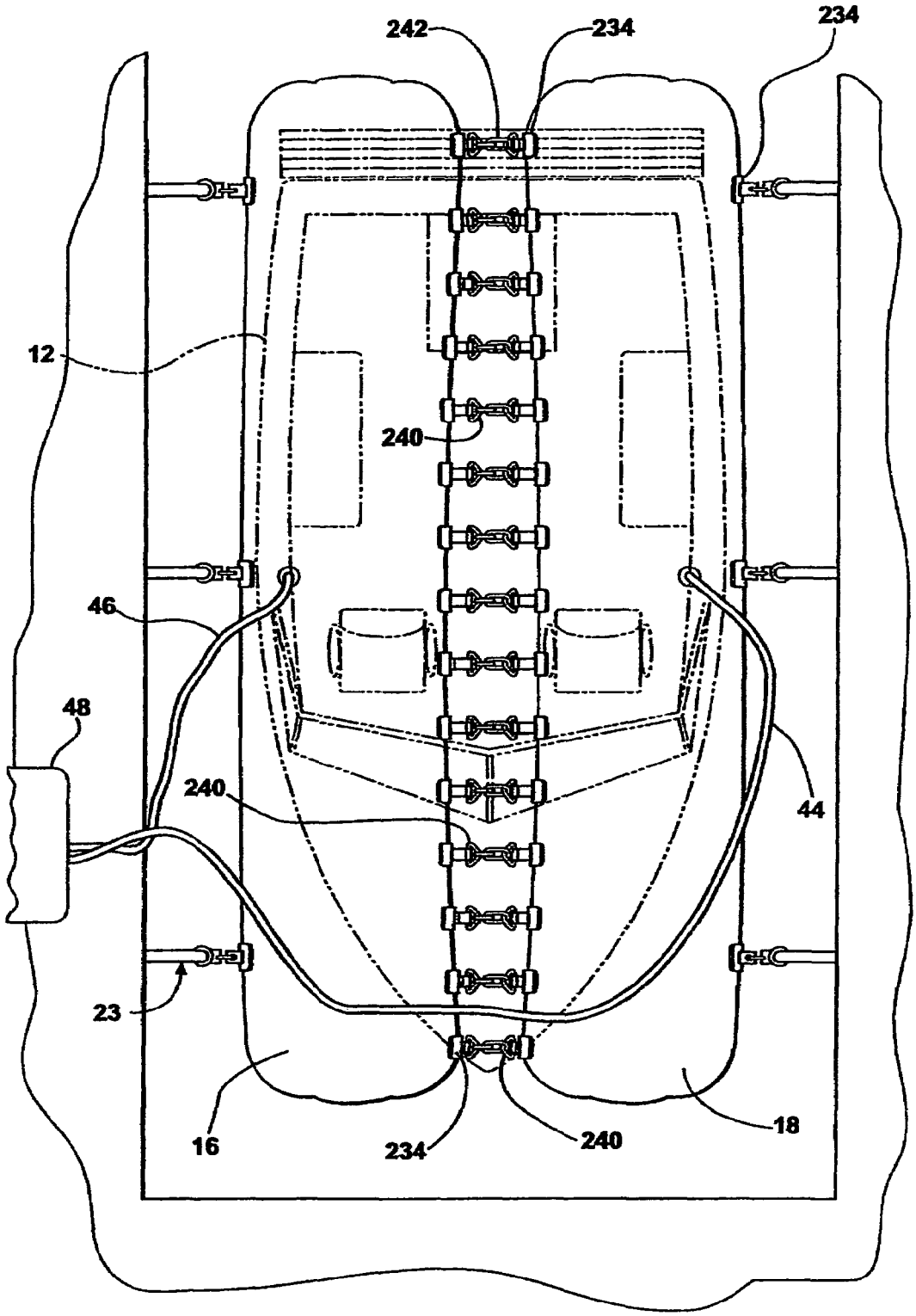
FIG. 8 is a top plan view showing a series of connector assemblies and chain links connecting two bladders together.
Figure 9:
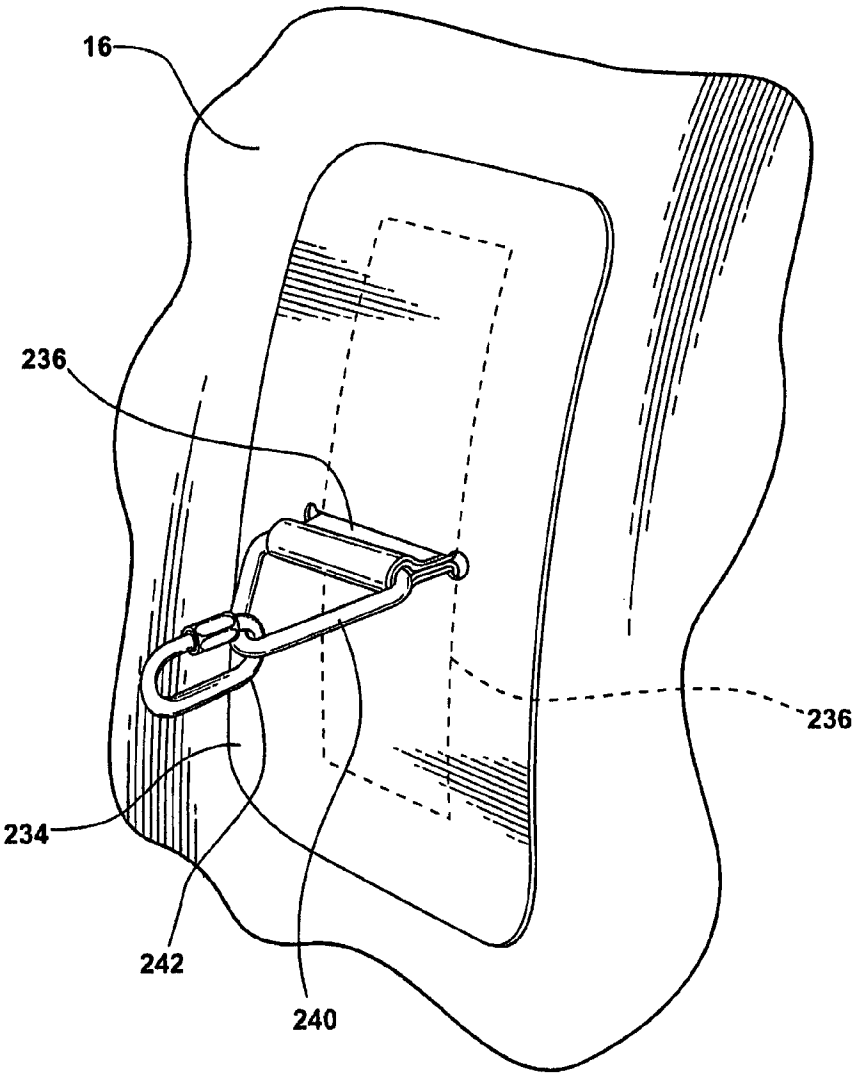
FIG. 9 is an enlarged perspective view of one connector assembly with a steel ring.

The dry storage assembly 10 for storing watercraft such as motorboats 12, sailboats 14, catamarans, and pontoon boats includes a pair of bladders 16 and 18, a blower system 20 for inflating and deflating the bladders, a retainer system 22 for attaching the bladders to each other, a locator system 23 for aligning the boat with the bladders, and a dry pouch for protecting boat parts that are not lifted from the water. The bladder 16 and 18 may be made from sheets of polyester scrim 24 that is substantially non-stretchable and encased in a flexible poly vinyl chloride plastic 30. Nylon scrim can be used in place of the polyester scrim. Nylon becomes substantially non-stretchable when loaded. The poly-vinyl chloride can be replaced or mixed with urethane. Other thermoplastics that remain flexible at temperatures of 32° Fahrenheit and somewhat lower and that can be bonded by heat can be employed. A seam binding strip (not shown) can be used to cover the exposed edge 28 and increase joint strength. The binding strip is bonded to the sheet material by heat. Seams in the material are made by over lapping two edges 26 and 28 of the material by about 2 inches, as shown in FIG. 7, and then heating the over lapping area with air from a blower having a heating coil. The air is heated by the coil to about 700° to 1,000° Fahrenheit. The joint is cooled by ambient air while the over lapping edges 26 and 28 are held in engagement with each other. The bladders 16 and 18 have a diameter of about 42 inches. The length of each bladder 16 and 18, as shown, is about 20 feet. A load of about 24,600 pounds would be required to sink one such bladder. However, about 60 to 80% of each bladder 16 and 18 should remain above the water when supporting a boat. Larger boats will require larger bladders with an increased bladder volume. The bladders 16 and 18 can be lengthened to increase the volume. The diameter can also be increased or decreased to change the volume or to accommodate a boat with different features.

The non-stretchable polyester or nylon scrim 24 in the bladders 16 and 18 tends to form bladders that are nearly cylindrical when fully inflated. The cross section of the inflated bladders approaches circular. The length from one end to the other approaches a straight line. As a result the hull 32 of a boat 12 or 14 tends to set up on top of the bladders 16 and 18. The bladders 16 and 18 can be longer than the boat 12 or 14 or shorter. The polyester scrim 24 that is non-stretchable tends to hold ends of the bladder 16 and 18 in the water at nearly the same depth as the center portion of the bladders thereby supporting a substantial share of the total weight. Nylon scrim also holds the ends of the bladders in the water when loaded by air under pressure.

Grommets 34 are secured to reinforcement pieces 36, of the scrim 24 encased in flexible poly vinyl chloride or similar material that is used to form a bladder 16 or 18 and bonded to both bladders in selected positions along the length of the bladders. The bonding is preferably done by heat but can also be accomplished with an adhesive. A plurality of retainer lines 38 are connected to grommets 34 to limit separation of two bladders 16 and 18 and form the retainer system 22. These lines 38 are attached in locations in which they do not interfere with rudders, screw shafts or the keel. The lines 38 are lengthened or shortened as required to hold the bladders 16 and 18 in the desired position relative to the hull 32. The grommets 34 together with reinforcement pieces 36 and the retainer lines 38 form the retainer system 22. The lines 38 generally do not need to be released or tightened to raise a boat from the water or lower a boat into the water because the dry storage assembly 10 is moved vertically into or out of engagement with a boat 12 or 14.

The blower system 20 for inflating and deflating bladders 16 and 18 includes a pressure tube connector 40 attached to the bladder 16 and a tube connector 42 attached to the bladder 18. These tube connectors 40 and 42 are connected to the bladders 16 and 18 where they are protected and generally do not interfere with a boat moving into a position to be raised or moving away from the dry storage assembly 10.

A port bladder tube 44 is connected to the tube connector 40. A starboard bladder tube 46 is connected to the connector 42. Both tubes 44 and 46 are preferably relatively large diameter tubes to accommodate the low pressure air supply 48. Two inch diameter tubes 44 and 46 work satisfactorily. However, larger tubes 44 and 46 would most likely be somewhat faster. The tubes 44 and 46 should not be collapsible so that air can be pumped from the bladders 16 and 18. The connections of the tubes 44 and 46 to the connectors 40 and 42 as well as the connections to the air supply 48 are releasable with a suitable tool. However, it would be convenient in some cases if there were rapid couplers of some type between the tubes 44 and 46 and the air supply 48.

The air supply 48 includes a plastic box 50 with a removable cover 52. An air manifold 54 is mounted inside the box 50. The manifold 54 has one port 58 with a valve 56 connected to a bladder tube 44. Another port 60 with a valve 62 is connected to the bladder tube 46. The third port 64 with a valve 66 is connectable to a blower or vacuum cleaner 68 by an air tube 70. A standard vacuum cleaner 68 discharges sufficient air to inflate both bladders 16 and 18 in about ten minutes. A standard vacuum cleaner 68 also produces sufficient air pressure when the bladders 16 and 18 have sufficient size. The vacuum cleaner 68 can be operated by a 110 volt alternating current through a terminal 74 or it can be operated by direct current. The ideal vacuum cleaner 68 should be reversible so that air can be supplied to the manifold 54 or sucked from the manifold. If the vacuum cleaner 68 is not reversible it will be necessary to shift the air tube 70 from an air outlet on the cleaner to a suction side of the blower inside the vacuum cleaner. The vacuum cleaner 68 can also be replaced by a commercially available air blower. Valves 56 and 62 are opened and closed as required to keep a boat hull 32 at the same elevation on both sides during lifting of the hull as well as during lowering of the hull. When lifting the boat hull 32 air tends to flow to the bladder 16 or 18 with the lightest load. When lowering the hull 32 into the water, air tends to flow faster out of a bladder 16 or 18 with the heaviest load to support. Failure to keep a boat hull 32 at equal elevation on both sides when the bladders 16 and 18 are supporting a portion of the weight could cause a boat 12 or 14 to slip off the bladders.

Figure 5:
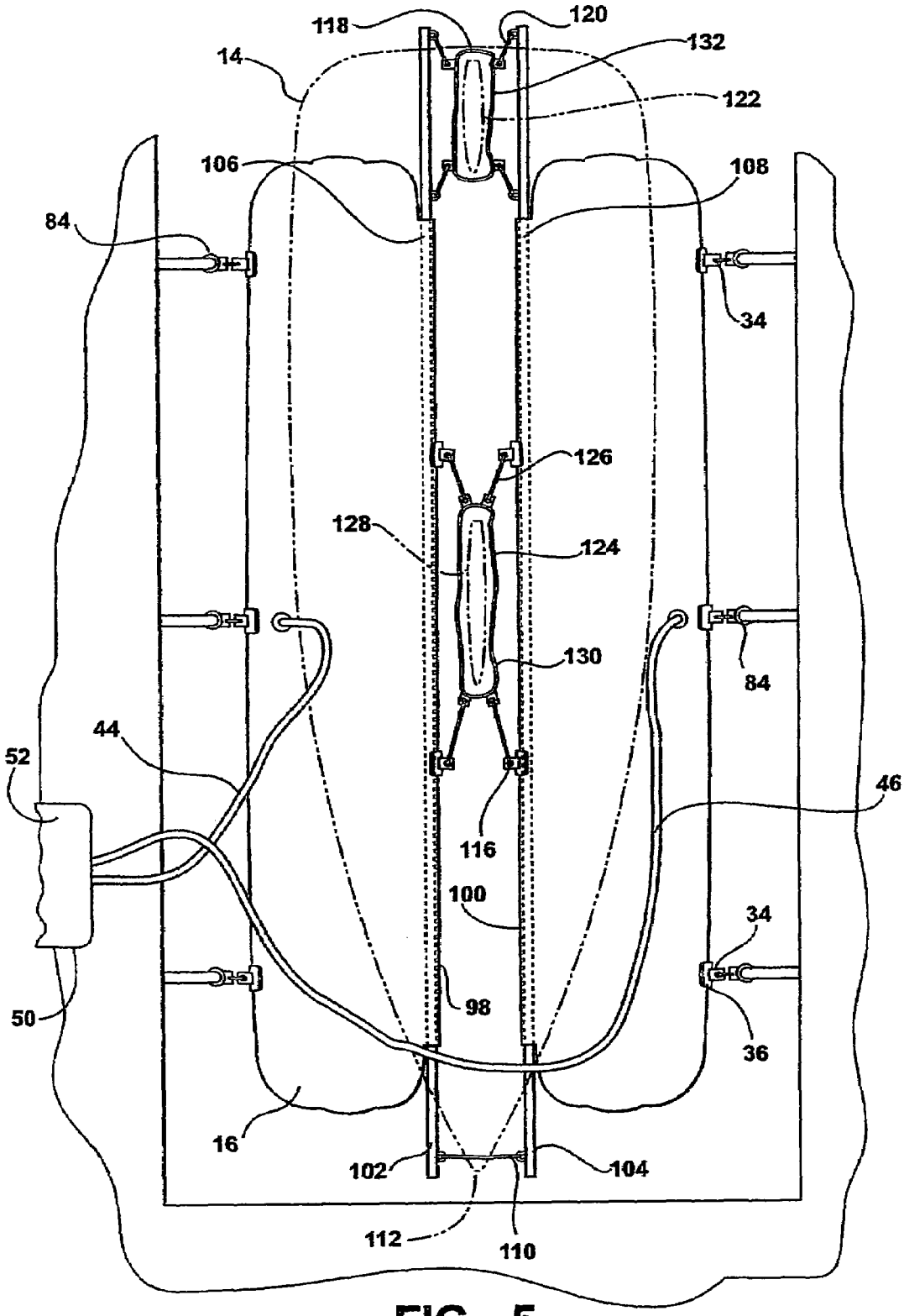
FIG. 5 is a top plan view of two bladders lifting a sailboat.

A boat 12 as well as the boat 14 are shown in the drawing Figures in a slip 76. The slip 76 is illustrated as a wharf 78 and with vertical walls 80. Vertical guide bars 82 are attached to both sides of the slip 76. Sliders 84 are slideably mounted on the vertical guide bars 82. Grommets 34 on the outer side walls of the bladders 16 and 18 are attached to the sliders 84 by bladder positioning lines 86. As shown in FIG. 5, there are three vertical guide bars 82 on each side of the slip 76 with sliders 84. Each slider 84 is connected to a grommet 34 on one of the bladders 16 and 18. The number of sliders 84 that are attached to the bladders 16 and 18 can be changed as required. Weights 88 are attached to the sliders 84 as required by lines 90. The bladders 16 and 18 tend to float in the water. The weights 88 are provided to pull the dry storage assembly 10 free of a boat hull 32 as quickly as possible. The vacuum cleaner 68 has a suction side that is connected to the bladder 16 and 18 to remove the air quickly. Even with the weights 88 and the pump 68 to remove air from the bladders, it generally takes longer to deflate the bladders 16 and 18 and free boat 12 or 14 to move out of a slip 76 then it takes to lift a boat hull, out of the water.

In an off shore anchorage situation, rather than a slip 76, the dry storage assembly 10 can be employed. Weights on the bottom are employed to fix the position of the bladders 16 and 18. Buoys can be used to mark the location of the weights. The tubes 44 and 46 are disconnected from the manifold 54, plugged and tied to an anchor buoy. The blower system is carried by the boat 12 or 14 rather than being positioned on a wharf 78. The dry storage assembly 10 is then employed the same way it would be employed with a slip 76.

Motorboats 12 have rudders, propeller and propeller shafts that extend down into the water below the hull 32. With many boat designs the rudder, propeller shaft and propeller can be raised out of the water by the bladders 16 and 18. When the rudder or propeller cannot be raised out of the water, they can be inserted into an envelope 92 with an open top 94 like the keel 96 of the sailboat 14 as described above.

The bladder 16 and 18, as shown in FIG. 5, have sleeves 98 and 100 formed on their inside edges. These sleeves are formed by attaching a strip of sheet material 25 used to form the bladder 16 and 18 to the outside surface of the bladders and securing the strips of material 106 and 108 in place by heating, as described above, or by an adhesive. A pipe 102 is inserted into the sleeve 98 formed by the strip of material 106. A pipe 104 is inserted into the sleeve 100 formed by the strip of material 108. The pipes 102 and 104 are longer than the bladders 16 and 18 and protrude from both ends of the sleeves 98 and 100. As shown in FIG. 5, a retainer line 110 limits separation of the pipes 102 and 104 at the bow 112 of the boat 14. Another line 110 can be attached to the pipes 102 and 104 at the stern 114 of the boat. Additional retainer lines 110 can be attached to grommet assemblies 116 attached to the strips of material 106 and 108. These grommet assemblies 116 are the same as the grommet 34 and reinforcement piece 36 described above. A rudder envelope 118 is attached to the pipes 102 and 104 by four lines 120 and receives a rudder 122. A keel envelope 124 is connected to grommet assemblies 116 by four lines 126 and receives a keel 128. The lines 120, 126 and 138 attaching envelopes also limit separation of the pipes 102 and 104. The top 130 of the keel envelope 124 and the top 132 of the rudder envelope 118 are raised above the water line 134 as the bladders 16 and 18 are inflated and the hull 32 of the boat 12 or 14 is raised out of the water. A series of attaching assemblies 234 with reinforcement pieces 236, with scrim 24 as shown in FIG. 7, and stainless steel triangular rings 240 can be attached to the sides of the bladders 16 and 18 in place of the sleeves 98 and 100. Stainless steel connector chain links 242 are used to connect assemblies 234 on one bladder 16 with the connector assemblies on the other bladder 18. Chain links 242 can be added to provide additional space between the bladders 16 and 18. Chain links 242 can be removed in areas in which space is required for a rudder or other boat assembly.

The envelopes 92, 118 and 124 are designed and constructed to fit the boat that the dry storage assembly 10 is to be used with. A single elongated envelope will fit some boats. More than four lines 126 are required for a single long envelope. Keel envelopes 92 or 124 as well as rudder envelopes 118 must be designed to fit the rudder 122 and the keel 128 they are to receive. They must also be attached to the bladder 16 and 18 in the proper location. If an envelope is to receive a propeller, the envelope must be able to receive the propeller and be positioned properly to do so.

Figure 4:
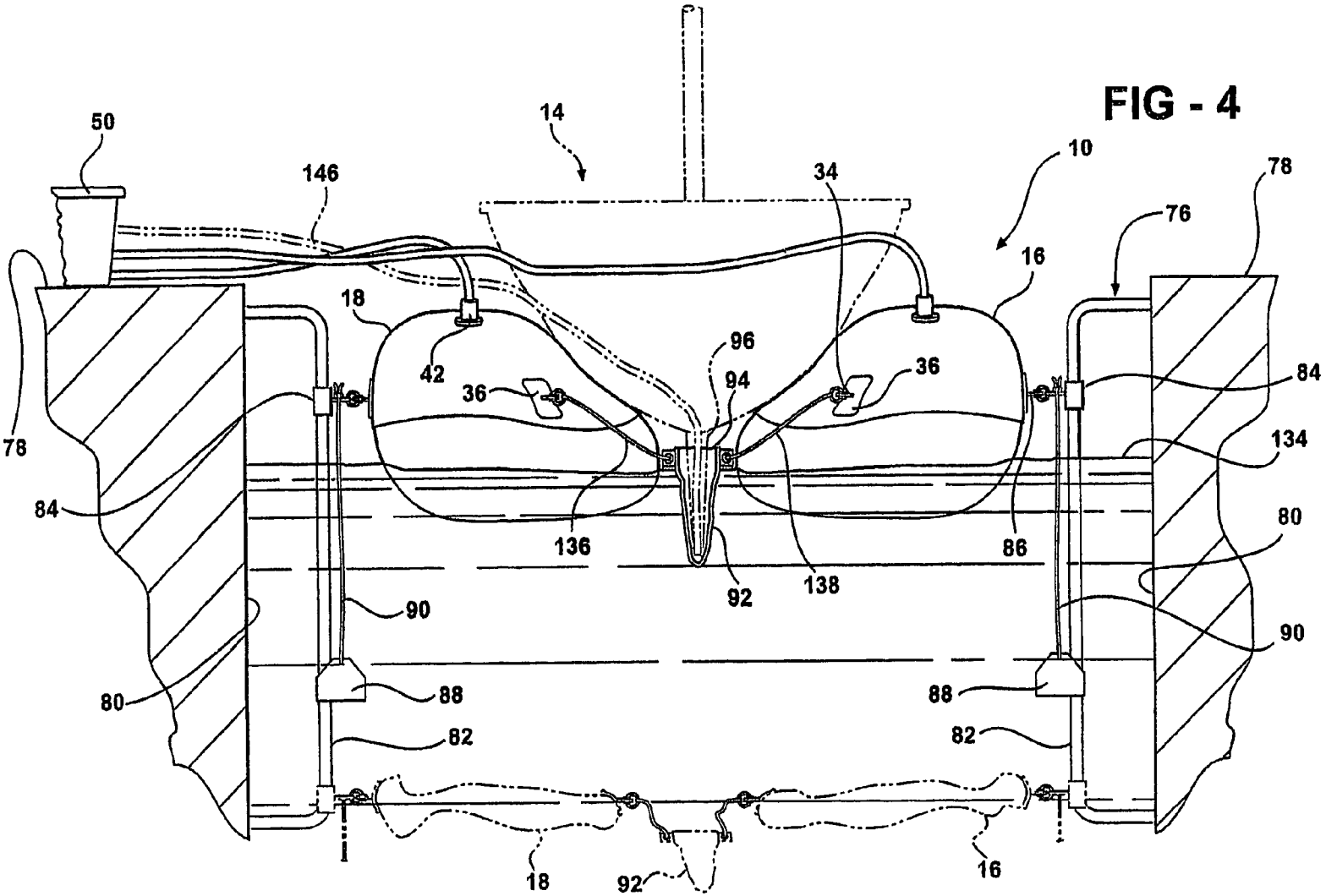
FIG. 4 is a front elevational view of a sailboat supported by two bladders and with a keel inside a dry container.

The envelope 92, shown in FIG. 4, is attached to grommet assemblies 34 and 36 attached directly to the bladders 16 and 18 by lines 136 and 138. The pipes 102 and 104 are not employed. Pipes 102 and 104 facilitate the connection of envelopes 118 and 124. However, the envelopes can in most cases be attached directly to the bladder 16 and 18.

The use of envelopes to encase keels, rudders, propellers and possibly other boat components requires the addition of a pump 140 to the box 50. The pump 140 has an inlet pipe 142 and a water discharge pipe 144. The inlet pipe 142 is connected to a line 146 shown in FIG. 4, that extends into the envelope 92. The pump 140 can be driven by an electric motor or it can be manually operated to remove water from the envelope 92. The end of the pipe 146 that extends into the envelope 92 should be secured in the envelope. When two or more envelopes 118 and 124 used, there should be a separate line 146 attached to each envelope to make sure all the water is removed from each envelope. Each line 146 is separately connected to the pump 140.

The employment of the dry storage assembly 10, as described above, relates to use with motorboats and sailboats. The assembly 10 will also work with catamarans and pontoon boats. However, this system for attaching the bladder 16 and 18 to such craft may require some modification to ensure that the hulls do not fall off the bladders 16 and 18. Increasing the length of retainer lines 38 will be sufficient for some such craft. Spreaders to hold the bladders apart may be required for other craft with two separate hull structures.

During employment of the dry storage assembly 10, two bladders 16 and 18 that are deflated are placed in a fixed position under the water a sufficient distance from a boat to be stored, to be passed over by a boat. Bladders 16 and 18 are attached to each other by retainer lines 22 with a desired length and in the appropriate locations for the boat to be stored. If the bladder 16 and 18 are in a boat slip 76, each bladder is position by two or more sliders 84 on vertical guide bars 82 and by bladder position lines 86. Weights 88 keep the bladder 16 and 18 from floating upward. Envelopes 92, are attached to the bladder 16 and 18 if required. A boat 12 or 14 to be lifted out of the water is then moved into the slip 76 and into a position directly above the bladder 16 and 18.

The vacuum cleaner 68 is turned on and valves 56, 60 and 66 are opened to supply air from the vacuum cleaner discharge to both bladders simultaneously. As the bladders 16 and 18 move into contact with the hull 32, a check is made to ensure that the bladders and the retainer line 38 are properly positioned relative to the boat hull. As air continues to be forced into the bladder 16 and 18, the rate of inflation is maintained to ensure that both bladders are filled at the same rate. The valve 56 or 62 is closed as required to slow the rate at which one of the bladders expands until the other bladder catches up and both sides of the boat are at the same elevation. The closed valve is then opened so that both bladders will fill as rapidly as possible. Water is pumped from any envelopes 92, 118 or 124 as soon as the upper edges 94, 130 or 132 are above the water surface 134, by energizing the pump 140. Upon both bladders being completely filled, the valve 66 is closed and the vacuum cleaner 68 is turned off. The time to fill two bladders 16 and 18 that are 20 feet long and 42 inches in diameter should be about 10 to 12 minutes depending upon the capacity of the vacuum cleaner 68 and the size of the port bladder tube 44 and the starboard bladder tube 46. The valves 56 and 62 are generally left open so that a leak will allow both bladders 16 and 18 to collapse together. The pump 140 is turned off as soon as the envelopes 92, 118 or 124 that are used have been drained.

To lower a boat 12 or 14 from dry storage into the water, the valves 56, 62 66 are open, and the vacuum cleaner 68 is reversed and energized to suck air from the bladders 16 and 18. The rate of deflation is monitored to ensure that both bladders deflate at that the same rate. If one side of the boat is closer to the water than the other side, the valve 56 or 62 for the bladder supporting the low side is closed. Upon both sides of the boat obtaining the same elevation, the closed valve 56 or 62 is opened again.

After the bladder 16 and 18 are fully deflated, the vacuum cleaner 68 is turned off and the valves 56 and 62 are closed. A check is made to ensure the bladders 16 and 18 and any envelopes 92, 118 and 124 and any retainer lines 38 are clear of the boat 12. The boat is then free to move from the slip. The procedure for a boat 12 or 14 in open water is substantially the same as procedure set forth above with a few exceptions. A mooring block and buoy are set. Bladder guide blocks are placed at the port bladder 18 outside edge and at the front end and the rear end of the port bladder 18. Bladder guide blocks are also placed at the starboard bladder 16 outside edge and at the front end and the rear end of the starboard bladder. Guide ropes and guide block buoys are secured to each bladder guide block. A slider 84 on each guide rope is attached to an adjacent bladder. A weight is attached to the bladder and to each slider to hold deflated bladders in place. A boat is then placed between the four guide block buoys and moored to the mooring block. The bladder tubes 44 and 46 are retrieved from the mooring buoy, unplugged and attached to the air manifold 54 in the box 50. The bladder 16 and 18 are then inflated as explained above. Once the boat is raised out of the water, the valve 56 is closed and the vacuum cleaner 68 is turned off. The bladder 16 and 18 may or may not remain attached to the slider on the guide ropes attached to the guide block buoys. The boat is returned to the water the same way as the boat in a slip is returned to the water.

The blower 68 and the valve 66 as described above are manually operated. When a watercraft 12 or 14 is being placed into dry storage or returned to the water there is a person available to monitor the operation. If the blower 68 runs too long, it would not be a problem because the maximum pressure generated by the blower is relatively low and is far below the pressure that would cause the bladders 16 and 18 to fail. However, the valve 66 and the blower 68 can be controlled by a control system that energized the blower 68 and opens the valve 66 anytime the air pressure in the bladders falls below a selected low pressure. The control system would also turn the blower 68 off and close the valve 66 when the air pressure exceeds a selected high pressure. An alternate version of the control system could turn the blower 68 off and close the valve 66 after a selected time interval. The automatic system increases the time intervals between periodic checks of the status of the bladders 16 and 18 and a watercraft supported by the bladders.

Inflated bladders 16 and 18 for lifting watercraft are more stable if the bladders are substantially rigid. To make a bladder 16 or 18 rigid, the material used to make the bladder is either substantially non-stretchable or a material that becomes substantially non-stretchable or a material that becomes substantially non-stretchable after the material is lightly loaded.

The forces on the material employed to construct the bladders 16 and 18 should exert sufficient force on the bladder wall material in a direction parallel to the long axis 352 to slide the bladder walls relative to a boat hull 32 as air pressure in the bladder increases. The elongation of the bladder material in contact with a boat hull 32 tends to straighten each bladder 16 and 18 thereby forcing the bladder ends into the water and providing more upward force on the boat hull. At the same time, as the pressure increases, the area of a vessel hull 32 in contact with the bladders 16 and 18 decreases. The hull surface area that is uncovered is exposed to air and dries.

The forces in the bladder material that is parallel to a long axis of each bladder is calculated by the following formula:

$$\frac{(\text{Area of a bladder end wall}) \times (\text{air pressure})}{\text{Bladder circumference}} = \text{force pounds/inch of material}$$

A minimum force parallel to the long axis 352 of the bladder 16 or 18 of at least 5 pounds per inch of material employing nylon or polyester scrim is desirable. A generally cylindrical bladder 16 or 18 with a forty two inch diameter and an internal gas pressure of 0.5 pounds per square inch has a force parallel to the long axis 352 of about 5.25 pounds per inch of material.

The bladder material used to make bladders 16 and 18 is also loaded in a direction transverse to the long axis 352 of the generally cylindrical bladders. A bladder hull engaging surface that can move freely in a direction transverse to the bladder's 16 or 18 long axis 352 is unstable. Loading on the material used to make a bladder 16 or 18 in a direction perpendicular to the long axis of the bladder is calculated by the following formula:

$$\frac{\text{Diameter of the bladder} \times (1\text{ inch}) \times (\text{air pressure})}{2} = \text{pounds per inch of material}$$

The minimum force in an inch of bladder material in a direction perpendicular to the bladder long axis 352 is 10 pounds per inch to insure that the bladder 16 or 18 is stable. The force in a bladder 16 or 18 with a forty two inch diameter and a pressure of 0.5 pounds per square inch is 10.5 pounds per inch of material in the bladder wall.

Bladders 16 and 18 made with polyester scrim 24 or nylon scrim encased in a plastic have a substantially constant volume once the internal air pressure exceeds the ambient air pressure by a small amount. Polyester is substantially non elastic. Nylon will stretch somewhat, but becomes rigid after stretching a small amount. Once the bladders 16 and 18 are pressurized by a 0.5 pounds per square inch, there is minimal increase in bladder volume with increases in the pressure inside the bladders. Bladders 16 and 8 which extend forward or rearward from vessel hull engagement will become more cylindrical with increases in internal gas pressure and the bladder ends will be forced downward thereby increasing the lifting force.

The lifting capacity of bladders 16 and 18 can be increased by increasing the length of the bladders or by increasing the bladder diameter. Both of these changes increase the quantity of material in the bladders, thereby increasing cost.

The lifting force of the bladders 16 and 18 can be decreased when used to lift lighter vessels decreasing bladder length or bladder diameter. A decrease in bladder length will decrease bladder weight as well as the volume of air required while leaving air pressure requirements substantially unchanged. A decrease in bladder diameter will decrease the forces on the bladder material parallel to the long axis of a bladder and decrease the force on the bladder material transverse to the long axis. It is desirable to keep the minimum forces on the bladder material up to at least 5 pounds per inch of material in a direction parallel to the bladder long axis and up to at least 10 pounds per inch in a direction transverse to the bladder long axis. To maintain the 5 pound per inch and the 10 pound per inch forces with a tube diameter less than forty two inches it will be necessary to increase gas pressure. Increased gas pressure will require more time to lift a boat and may require a larger air pump. The larger pump will increase apparatus costs and operating costs.

Figure 10:
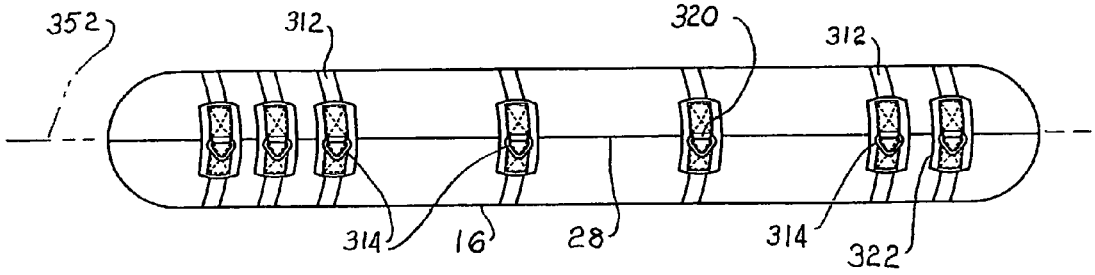
FIG. 10 is a side elevation of the starboard bladder with strap assembly bladder retainers.
Figure 11:
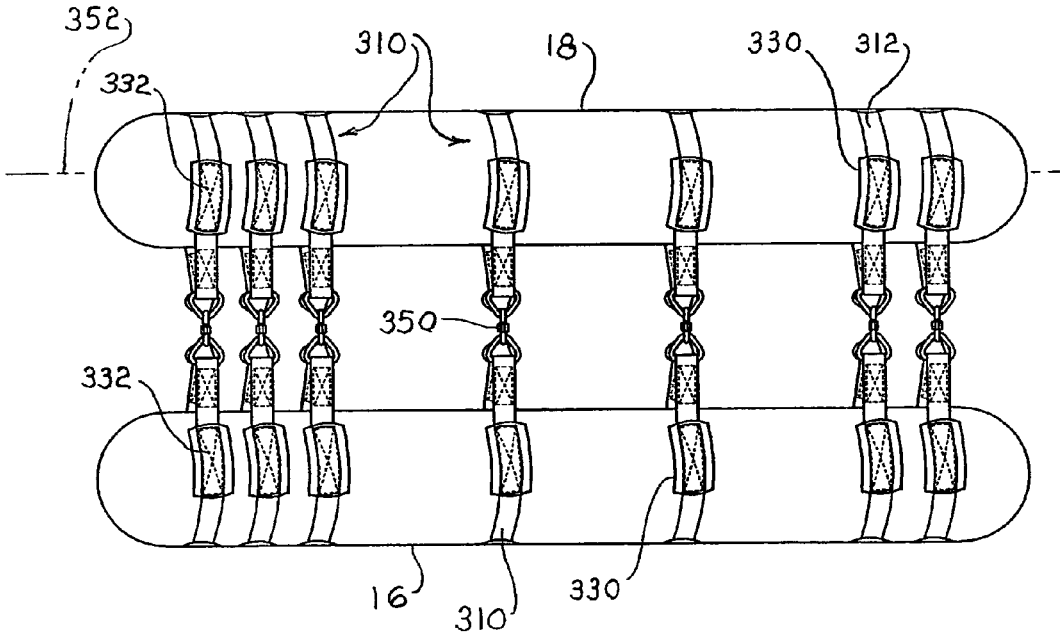
FIG. 11 is a top plan view of the boat lifting bladders and strap assembly retainers.
Figure 12:
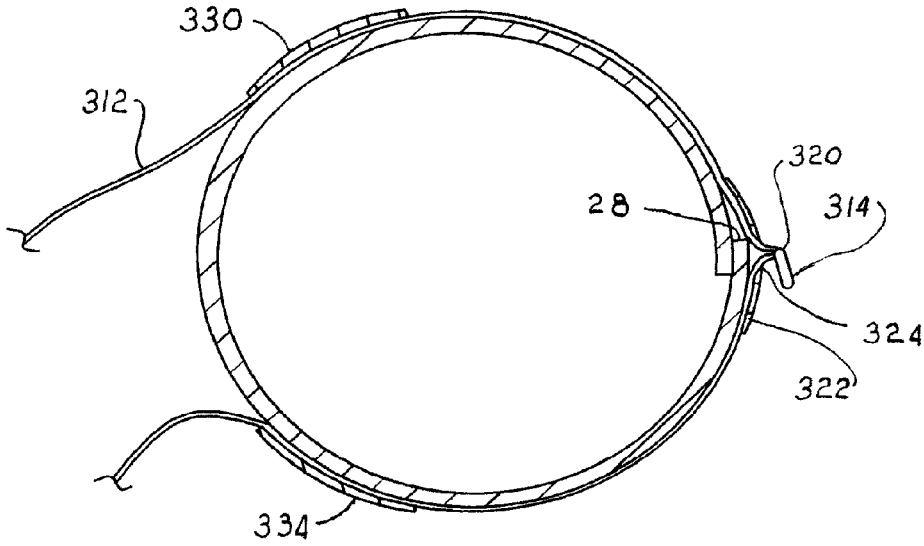
FIG. 12 is an enlarged sectional view of one bladder with parts broken away.

A single cylindrical bladder 16 or 18 will rotate about the bladder long axis 352 unimpeded. This problem is solved by connecting two bladders together with a plurality of strap assemblies 310 as shown in FIGS. 10 and 11. Each strap assembly 310 includes a nylon strap 312 that is longer than the diameter of one of the bladders 16 or 18. A stainless steel triangular ring 314 is attached to the nylon strap 312 midway between the ends 316 and 318 of the strap. Heavy duty nylon thread forms stitches across the strap 312 adjacent to one side member of the triangular ring 314 to form a loop 320 in the strap that retains the triangular ring. A generally rectangular panel 322 of bladder material has a central transverse slot 324. The triangular ring 314 passes through the transverse slot 324. Both portions of the panel 322 are sewn to the nylon strap 32 on opposite sides of the loop 320 by heavy nylon thread stitches 326 and 328. A second generally rectangular panel 330 of bladder material is sewn to the nylon strap 312 between the strap end 316 and the triangular ring 314 by heavy nylon thread 332. A third generally rectangular panel 334 of bladder materials sewn to the nylon strap 312 between the strap end 318 and the triangular ring 314 by heavy nylon thread 336. The strap end 316 passes through a stainless steel triangular ring 338, is folded back to form an upper bight 340 and is sewn with heavy nylon thread 342 to retain the stainless steel ring. The strap end 318 passes through a lower stainless steel triangular ring 344. The strap end 318 is folded back against the strap 312 to form a lower bight 346 and is sewn with heavy nylon thread 348 to retain the lower stainless steel triangular ring 344.

A plurality of strap assemblies 310 are placed around the bladder 16. A plurality of strap assemblies 310 are also placed around the bladder 18. The stainless steel triangular ring 314 is aligned with an edge 28 of the bladder seam that extends the length of each bladder 16 or 18 and across both bladder ends. The rings 314 are placed in selected positions along the length of each seam edge 28 with the strap 312 crossing the edge 28 perpendicular to the seam edge. The upper triangular rings 338 and the lower triangular rings 334 of two strap assemblies 310 on adjacent bladders 16 and 18 are connected to each other by a chain coupler 350. Each pair of strap assemblies 310 that are directly across from each other and spaced along the axis 352 of each bladder 16 and 18 are connected together by chain couplers 350 as explained above.

The generally rectangular panel 322 of bladder material that crosses one of the seam edges 28 is bonded to the outside bladder wall by heat as explained above. These rectangular panels 322 strengthen the bladder joint and eliminate rotation of the bladder 18 relative to the strap assemblies.

The second generally rectangular panel 330 on each strap assembly 310 is positioned to engage the hull 32 of a boat. These panels 330 help the bladders 16 and 18 expand along the hull 32 of a boat as the bladders are inflated and facilitate sliding of the strap assemblies 310 relative to a boat hull.

Figure 1:
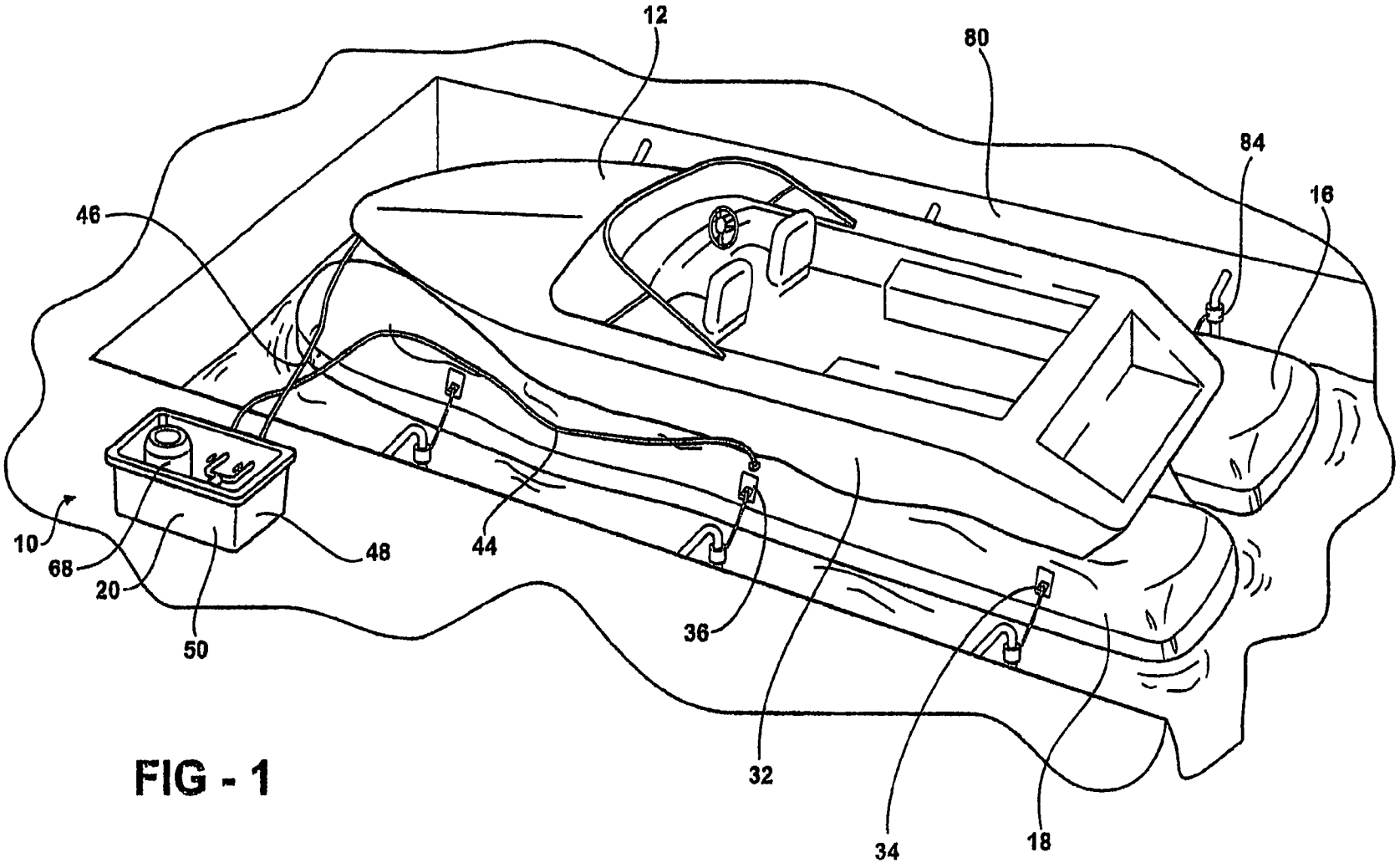
FIG. 1 is a perspective view of a boat in a boat slip and raised out of the water by two inflatable bladders.
Figure 2:
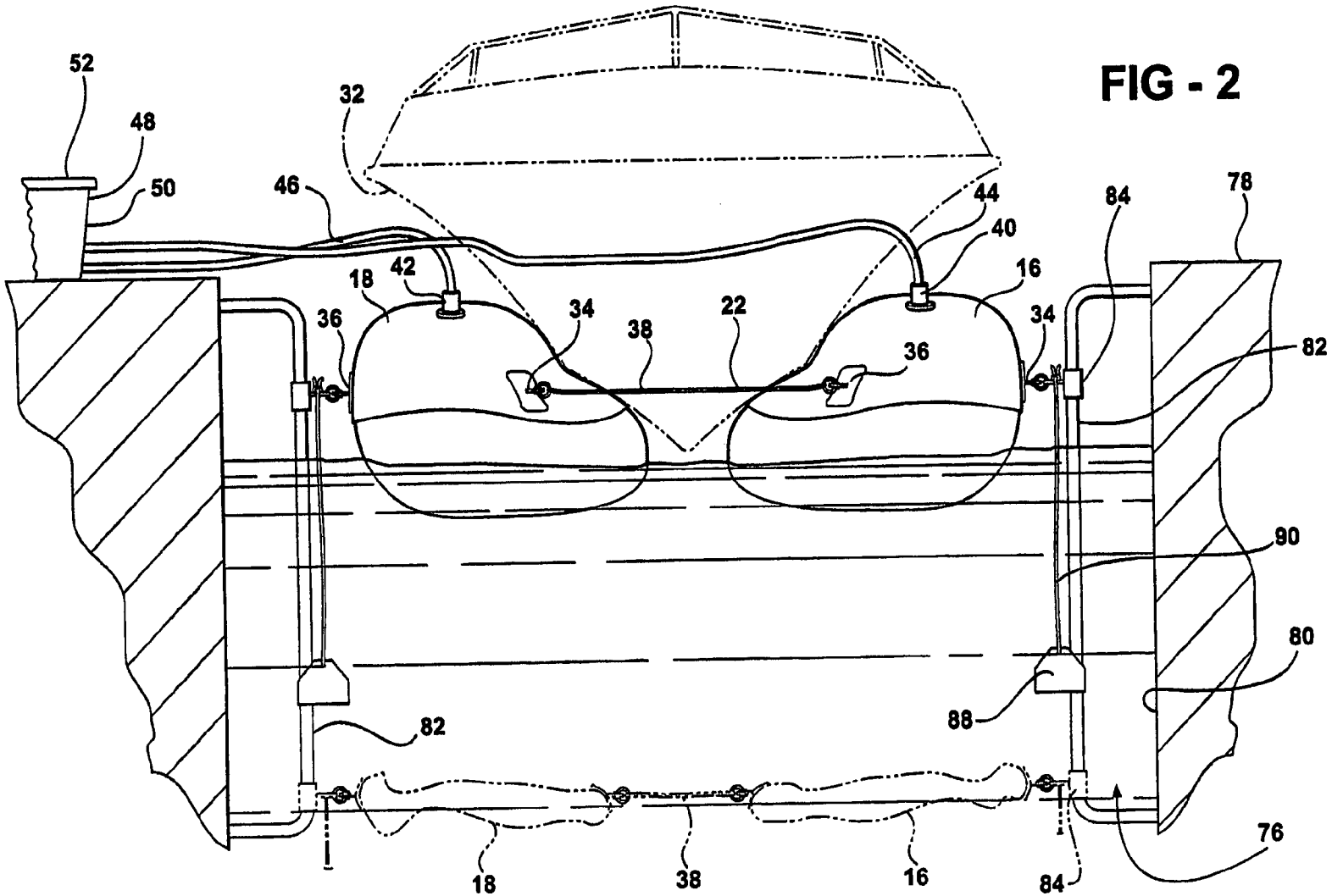
FIG. 2 is a front elevational view of the boat of FIG. 1 supported by the bladders and held out of the water.
Figure 3:
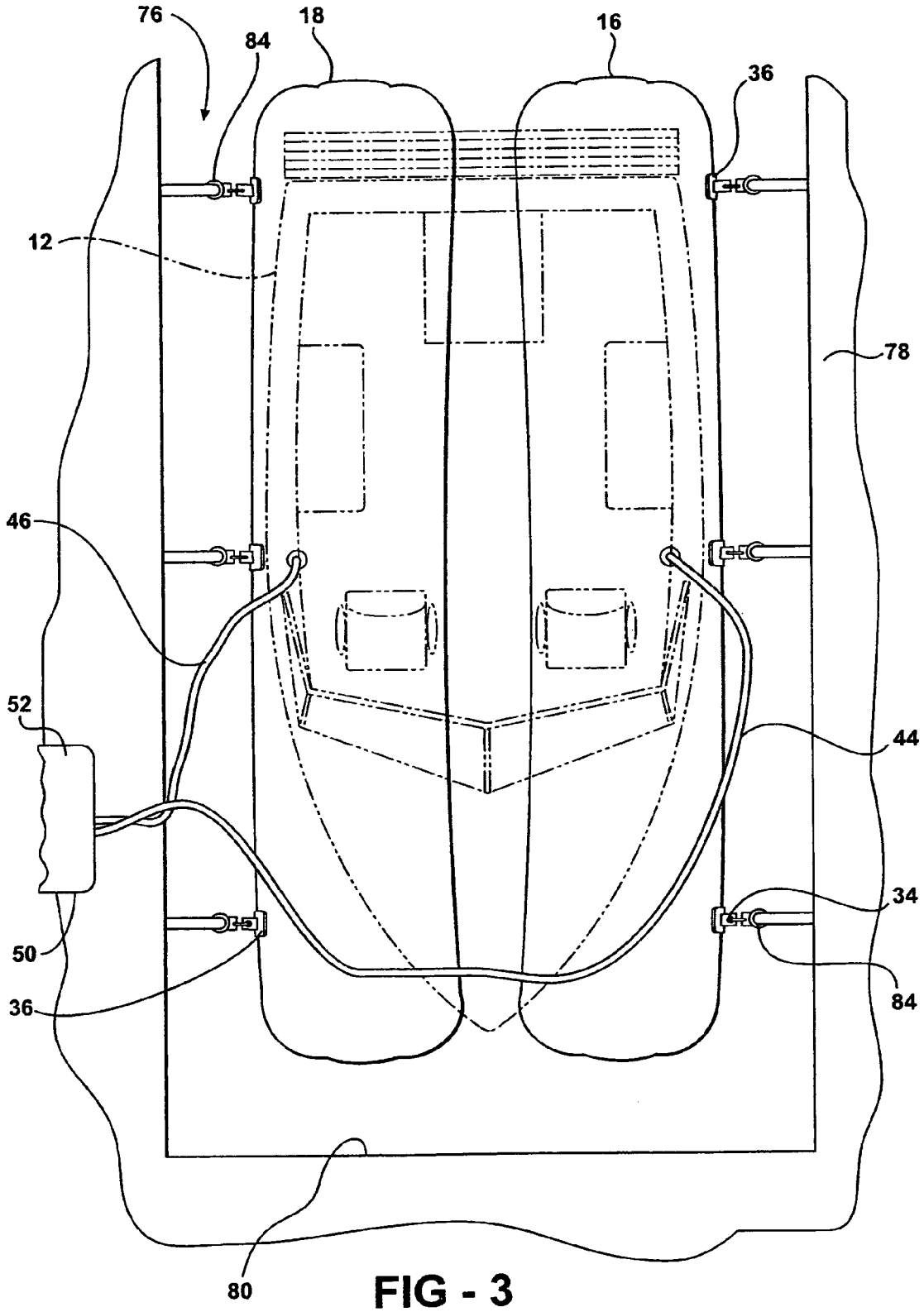
FIG. 3 is a top plan view of the boat of FIG. 1 lifted out of the water by two bladders.

The third generally rectangular panels 334 on each strap assembly 310 performs the same function as the second generally rectangular panel 330 if the port bladder 18 and the starboard bladder 16, as shown in FIG. 3, switch sides.

There are three strap assemblies 310 that are close together adjacent to the stem as shown in FIG. 11. These strap assemblies 310 are on about one foot centers. There are three spaces about three feet wide between strap assemblies 310 in the center of the vessel 12 to be held out of the water. The two strap assemblies 310 adjacent to the bow end of the bladders 16 and 18 are spaced about a foot apart. The three strap assemblies 310 adjacent to the stem are close together where the engine or engines and most of the weight is located. There are two close together strap assemblies 310 on the bow end of the bladders to insure that the ends of the bladders 16 and 18 do not diverge from each other. If the bladders 16 and 18 are to be used to support a sail boat 14, the strap assemblies 310 will need to be arranged to accommodate a rudder and a keel.

Figure 13:
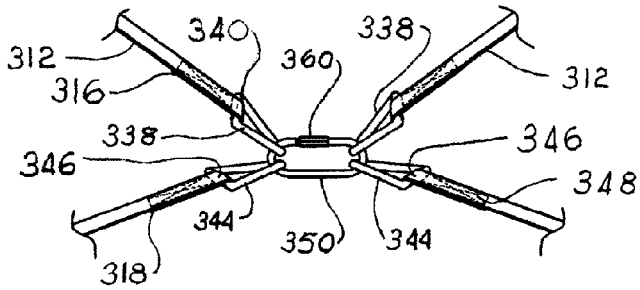
FIG. 13 is an elevational view of the connection between the strap assemblies on two adjacent bladders with parts broken away.
Figure 14:
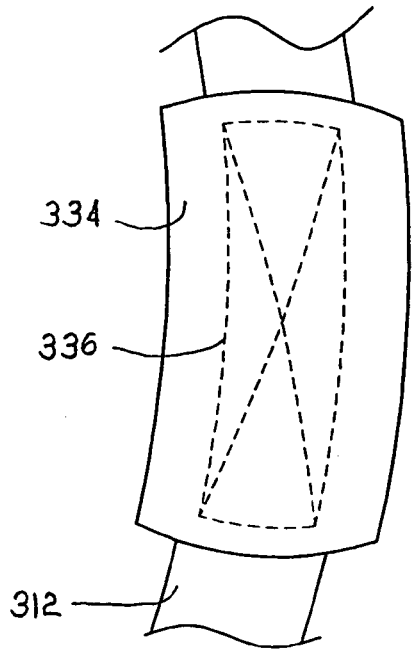
FIG. 14 is a perspective view of a generally rectangular panel sewn to a nylon strap and with parts broken away.
Figure 15:
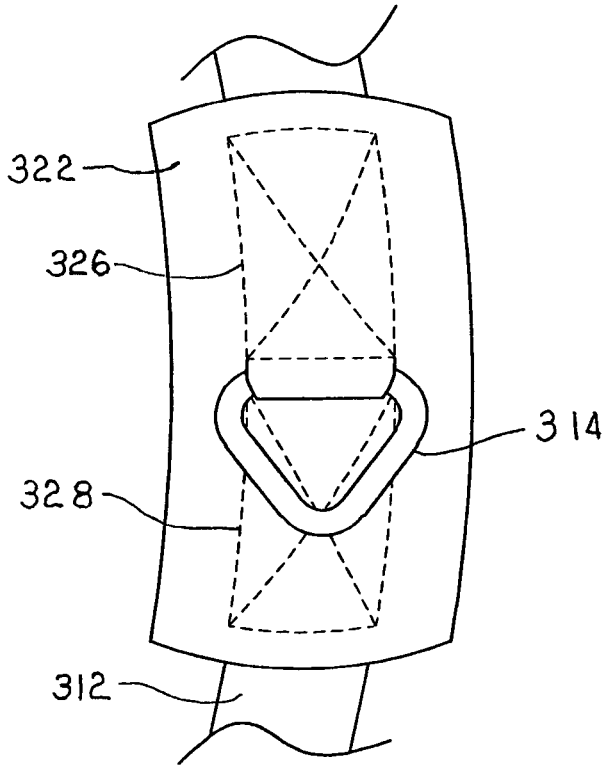
FIG. 15 is a perspective view of the triangular stainless steel ring attached to the outboard portion of the strap of a strap retainer and a generally rectangular panel sewn to strap with parts broken away.

One chain coupler 350 is shown in FIG. 13 connecting two upper triangular rings 338 and two lower triangular rings 344 together. If desired additional chain couplers 350 can be added to provided additional space between the bladders 16 and 18. It should be noted however that the single chain coupler 350 with a threaded sleeve closure 360 for opening and closing the coupler substantially eliminates rotation of one bladder 16 relative to the other bladder 18.

The generally rectangular panels 330 and 334 are heat bonded to the bladders 16 and 18 to further secure the straps to the bladders.

I claim:

1. A watercraft dry storage assembly comprising:

a port bladder made from a sheet material with a substantially non-stretchable scrim encased in a flexible plastic and formed into a generally cylindrical air impervious container;

a starboard bladder made from sheet material with a substantially non-stretchable scrim encased in a flexible plastic and formed into a generally cylindrical air impervious container;

a plurality of port strap assemblies spaced apart along a port bladder long axis, each of the port strap assemblies including an elongated strap substantially encircling the port bladder, an upper port ring attached to an upper end of the elongated strap, and a lower port ring attached to a lower end of the elongated strap;

a plurality of starboard strap assemblies spaced apart along a starboard bladder long axis, each strap assembly including an elongated strap substantially encircling the starboard bladder, an upper starboard ring attached to an upper end of the elongated strap, and a lower starboard ring attached to a lower end of the elongated strap;

a plurality of coupler assemblies each of which connects the upper port ring and the lower port ring of one port strap assembly, and the upper starboard ring and the lower starboard ring of one starboard strap assembly together;

at least two panels each of which is sewn to one of the plurality of port strap assemblies midway between the upper port ring and the lower port ring and wherein the at least two panels are fixed to the port bladder;

at least two panels each of which is sewn to one of the plurality of starboard strap assemblies midway between the upper starboard ring and the lower starboard ring and wherein the at least two panels are fixed to the starboard bladder; and a blower system including a blower connected to a manifold, a port bladder tube connected to the port bladder and to the manifold, a starboard bladder tube connected to the starboard bladder and to the manifold, a first valve controlling the flow of air between the manifold and the port bladder, and a second valve controlling the flow of air between the manifold and the starboard bladder.

2. A watercraft dry storage assembly, as set forth in claim 1, wherein each of the plurality of coupler assemblies includes a chain coupler closure for opening and closing one of the plurality of coupler assemblies.

3. A watercraft dry storage assembly, as set forth in claim 1, wherein each of the plurality of coupler assemblies includes a plurality of chain couplers.

4. A watercraft dry storage assembly, as set forth in claim 1, wherein each of the plurality of coupler assemblies includes a plurality of chain couplers each of which includes a tubular coupler gate.

5. A watercraft dry storage assembly, as set forth in claim 1, wherein each of the port strap assemblies includes a panel sewn to the elongated strap and fixed to the port bladder; and each of the starboard strap assemblies includes a panel sewn to the elongated strap and fixed to the starboard bladder.

6. A watercraft dry storage assembly, as set forth in claim 1, wherein at least two of the port strap assemblies each include a panel sewn to the elongated strap and fixed to the port bladder; and wherein at least two of the starboard strap assemblies each include a panel sewn to the elongated strap and fixed to the starboard bladder.

7. A watercraft dry storage assembly, as set forth in claim 1, wherein each of the plurality of port strap assemblies includes a metal ring secured to the elongated strap half way between the upper port ring and the lower port ring; and each of the plurality of starboard strap assemblies includes a metal ring secured to the elongated strap half way between the upper starboard ring and the lower starboard ring.

8. A watercraft dry storage assembly, as set forth in claim 1, wherein the at least two panels fixed to the port bladder bridge a port bladder seam that is parallel to the port bladder long axis; and Wherein the at least two panels fixed to the starboard bladder bridge a starboard bladder seam that is parallel to the starboard bladder long axis.

* * * * *